US008257127B2

(12) United States Patent
Nakamura et al.

(10) Patent No.: US 8,257,127 B2
(45) Date of Patent: Sep. 4, 2012

(54) METHOD FOR MANUFACTURING IGNITION PLUG

(75) Inventors: Toru Nakamura, Aichi (JP); Tomoaki Kato, Aichi (JP); Yuichi Yamada, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 102 days.

(21) Appl. No.: 12/399,096

(22) Filed: Mar. 6, 2009

(65) Prior Publication Data

US 2009/0227168 A1 Sep. 10, 2009

(30) Foreign Application Priority Data

Mar. 7, 2008 (JP) ..... P2008-058251

(51) Int. Cl.
*H01T 21/02* (2006.01)

(52) U.S. Cl. ..... 445/7; 313/118

(58) Field of Classification Search ..... 313/118–145; 445/7

See application file for complete search history.

(56) References Cited

U.S. PATENT DOCUMENTS

| | | | | |
|---|---|---|---|---|
| 3,988,646 | A | 10/1976 | Atkins et al. | 317/96 |
| 4,490,122 | A * | 12/1984 | Tromeur | 445/7 |
| 6,080,029 | A | 6/2000 | Johnson et al. | 445/7 |
| 6,992,426 | B2 | 1/2006 | Francesconi et al. | 313/144 |
| 7,305,954 | B2 | 12/2007 | Hagiwara et al. | 123/143 |
| 7,328,677 | B2 | 2/2008 | Hagiwara et al. | 123/143 |
| 2007/0069618 | A1 * | 3/2007 | Havard et al. | 313/141 |
| 2007/0114901 | A1 * | 5/2007 | Nagasawa et al. | 313/141 |
| 2007/0221156 | A1 | 9/2007 | Hagiwara et al. | 123/143 |
| 2007/0221157 | A1 | 9/2007 | Hagiwara et al. | 123/143 |

FOREIGN PATENT DOCUMENTS

| | | |
|---|---|---|
| JP | 50-112632 | 9/1975 |
| JP | 2-37486 | 3/1990 |
| JP | 2-265143 | 10/1990 |
| JP | 7-057849 | 3/1995 |
| JP | 2003-36953 | 2/2003 |
| JP | 2003-506853 | 2/2003 |
| JP | 2007-287665 | 11/2007 |
| JP | 2007-287666 | 11/2007 |

OTHER PUBLICATIONS

Notification of Reasons for Refusal (dated Mar. 22, 2011) issued in connection with corresponding Japanese Patent Application No. 2009-048943, with English translation.

Notification of Reasons for Refusal (dated May 29, 2012) issued in connection with corresponding Japanese Patent Application No. 2009-048943, with English translation.

* cited by examiner

*Primary Examiner* — Anh Mai
*Assistant Examiner* — Andrew Coughlin
(74) *Attorney, Agent, or Firm* — Kusner & Jaffe

(57) ABSTRACT

A method for manufacturing an ignition plug is provided. The method includes: preparing an insulator having a cavity provided at a leading end portion thereof by disposing a leading end of a center electrode more inwards in an axial hole than a leading end of the insulator; building the insulator in an interior of a metal shell; disposing a ground electrode at a leading end portion of the metal shell; positioning a center of a through hole of the ground electrode and a center of the cavity of the insulator; and welding the ground electrode and the metal shell together after the positioning step.

15 Claims, 13 Drawing Sheets

METHOD FOR MANUFACTURING IGNITION PLUG

FIELD OF THE INVENTION

The present invention relate to a method for manufacturing ignition plug such as a plasma-jet spark plug.

BACKGROUND OF THE INVENTION

Conventionally, spark plugs which ignite air-fuel mixtures by spark discharge have been used for ignition plugs for internal combustion engines of automobiles. In recent years, higher power outputs and lower fuel consumptions have been demanded of such internal combustion engines. Because of this, efforts have been made to develop plasma-jet spark plugs that can ignite leaner air-fuel mixtures which burn out quickly and whose ignitable limit air-fuel ratios are higher.

For example, Japanese unexamined patent application publication No. JP-A-2007-287666 describes a related art plasma-jet spark plug. The related art plasma-jet spark plug has a structure in which a cavity having a small capacity is formed as a discharge space by surrounding the periphery of a spark discharge gap between a center electrode and a ground electrode by an insulator.

The related art plasma-jet spark plug has been manufactured by taking, in general, the following steps (1) to (3). (1), A plate-shaped ground electrode in which a through hole is formed in a center, is press fitted in a ground electrode mounting portion provided at a leading end of a metal shell with a predetermined fitting tolerance. (2) The metal shell and the ground electrode are laser welded together. (3) An insulator in which a center electrode is built in advance is held within the metal shell to which the ground electrode has been welded by the insulator being crimped to a predetermined engagement portion.

In the manufacturing method described above, however, in the step (3), there was a case where when the insulator was made to be held within the metal shell, a shift in position, or "position error," occurred between the center axis of the through hole in the center of the ground electrode and the center axis of a cavity provided on the insulator. As this occurred, there was concern that spark discharge was performed locally, resulting in a phenomenon in which the ground electrode became worn locally. In addition, when the center axis of the through hole in the center of the ground electrode shifted from the center axis of the cavity provided on the insulator, there was concern that part of the cavity which functioned as a discharge space was closed by the ground electrode, and as this occurred, a quenching action was caused, resulting in a fear that the igniting performance was reduced.

SUMMARY OF THE INVENTION

Accordingly, it is an aspect of the invention to provide a manufacturing method of an ignition plug which can eliminate a shift in position between a center axis of a through hole provided in the center of a ground electrode and a center axis of a cavity provided in an insulator.

Exemplary embodiments of the present invention address the above disadvantages and other disadvantages not described above. However, the present invention is not required to overcome the disadvantages described above, and thus, an exemplary embodiment of the present invention may not overcome any of the problems described above.

According an illustrative aspect of the invention, there is provided a manufacturing method for a ignition plug comprising an insulator having an axial hole and a center electrode provided in the axial hole, a substantially cylindrical metal shell and a plate-shaped ground electrode having a through hole formed in a center thereof, the manufacturing method comprising: a preparation step of preparing an insulator having a cavity provided at a leading end portion thereof by disposing a leading end of the center electrode more inwards in the axial hole than a leading end of the insulator; a build-in step of building the insulator in an interior of the metal shell; a disposing step of disposing the ground electrode at a leading end portion of the metal shell; a positioning step of positioning a center of the through hole of the ground electrode and a center of the cavity of the insulator; and a welding step of welding the ground electrode and the metal shell together after the positioning step.

According to the manufacturing method of the aspect of the invention described above, the center of the through hole of the ground electrode and the center of the cavity of the insulator can be positioned before the ground electrode and the metal shell are welded together. Because of this, a shift in position between a center axis of the through hole and a center axis of the cavity can be eliminated.

BRIEF DESCRIPTION OF THE DRAWINGS

Illustrative aspects of the invention will be described in detail with reference to the following figures wherein.

DETAILED DESCRIPTION OF PREFERRED EMBODIMENTS OF THE PRESENT INVENTION

Hereinafter, manufacturing methods of ignition plugs as exemplary embodiments of the invention and the structures of ignition plugs that are manufactured by the manufacturing methods will be described. As a matter of conveniences in the description thereof, a specific structure of an ignition plug will first be described by reference to the drawings. The exemplary embodiments relate to a method for manufacturing ignition plug such as a plasma-jet spark plug.

A. Structure of Ignition Plug

Figure 1:
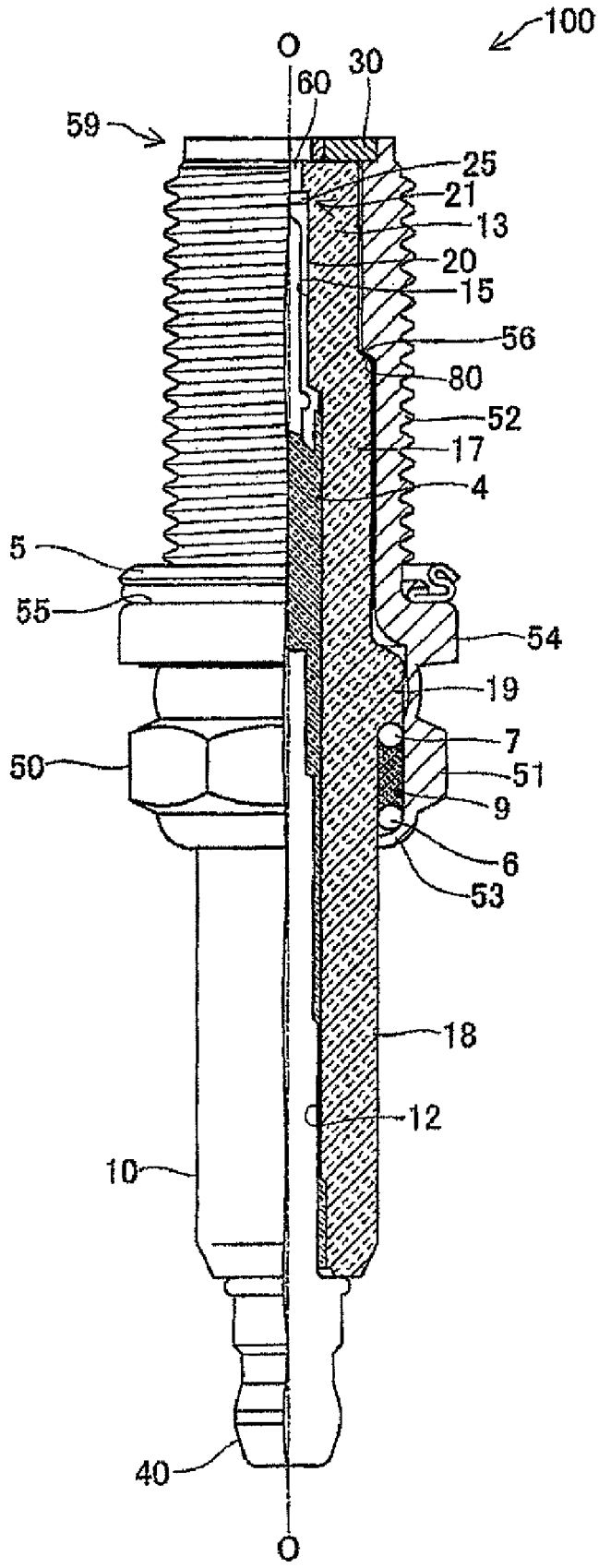
FIG. 1 is a partial sectional view showing the structure of an ignition plug 100.
Figure 2:
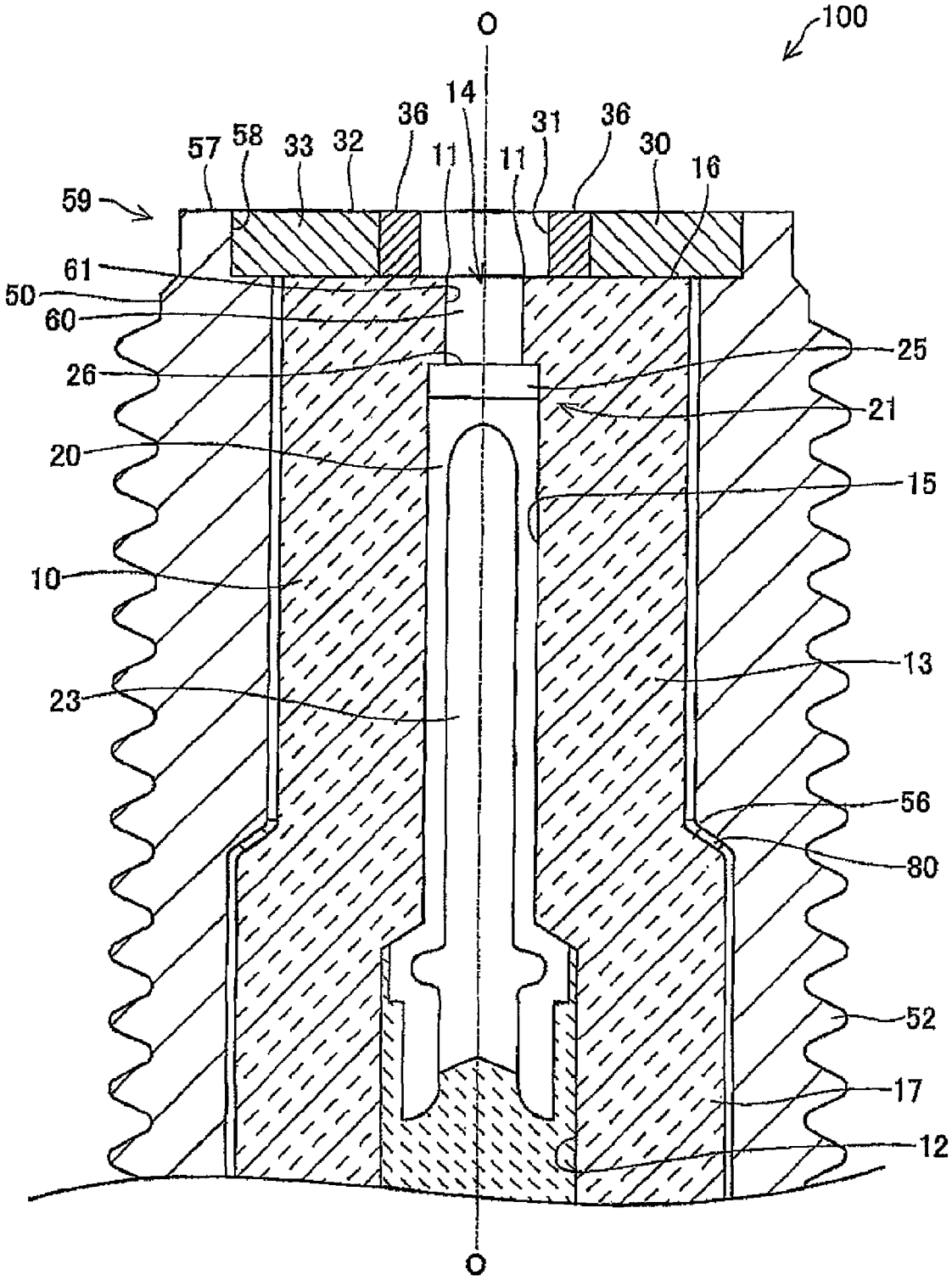
FIG. 2 is an enlarged sectional view of a leading end portion of the ignition plug 100.

FIG. 1 is a partial sectional view showing the structure of an ignition plug 100. In addition, FIG. 2 is an enlarged sectional view of a leading end portion of the ignition plug 100. Note that in FIG. 1, a direction of an axis O of the ignition plug 100 is referred to as a vertical direction, as viewed in the figure. In the following, an upper side of the ignition plug 100 shall hereinafter be referred to as a leading end side and a lower side shall be referred to as a rear end side.

As shown in FIG. 1, the ignition plug 100 includes a porcelain insulator 10 as an insulator, a metal shell 50 which holds the porcelain insulator 10, a center electrode 20 which is held in the axis O direction within the porcelain insulator 10, a ground electrode 30 which is welded to a leading end portion 59 of the metal shell 50, and a metal terminal casing 40 which is provided at a rear end portion of the porcelain insulator 10.

The porcelain insulator 10 is formed by calcining aluminum oxide and is a cylindrical insulation member having an axial hole 12 extending therethrough in the direction of the axis O. A collar portion 19 having a largest outside diameter is formed in a substantially center of the porcelain insulator in the direction of the axis O thereof. A rear end side body portion 18 is formed so as to extend from this collar portion towards a rear end side of the porcelain insulator 10. A leading end side body portion 17 extends from this collar portion towards a leading end side of the porcelain insulator 10. The leading end side body portion 17 has a smaller outside diameter than that of a rear end side body portion 18 that extends from collar portion 19 toward a rear end side of the porcelain insulator 10. An extended leg portion 13 having a smaller outside diameter than that of the leading end side body portion 17, extends from leading end side body portion 17 toward the leading end side of porcelain insulator 10. The extended leg portion 13 being positioned closer to the leading end side than the leading end side body portion 17. A boundary position between the extended leg portion 13 and the leading end side body portion 17 is formed into a step-like configuration.

As shown in FIG. 2, a portion of the axial hole 12 which corresponds to an inner circumference of the extended leg portion 13 is formed as an electrode accommodating portion 15. Electrode accommodating portion 15 is formed smaller in diameter than a portion which corresponds to inner circumferences of the leading end side body portion 17, the collar portion 19 and the rear end side body portion 18. The center electrode 20 is held in an interior of the electrode accommodating portion 15. In addition, the inner circumference or inside diameter of the axial hole 12 is reduced further at a leading end side of the electrode accommodating portion 15, so that the portion of the axial hole 12 whose inside diameter is so reduced is formed as a leading end smallest diameter portion 61. In addition, the inner circumference of the leading end smallest diameter portion 61 continues to a leading end face 16 of the porcelain insulator 10, and defines an opening 14 of the axial hole 12.

The center electrode 20 is a cylindrical electrode rod which is formed of a Ni-based alloy, such as by way of example and not limitation, Inconel (trade name) 600 or 601 and has in an interior thereof a metal core 23 which is made of a copper having superior heat conductivity. In addition, a disk-shaped electrode chip 25, which is made of an alloy mainly made of a noble metal and tungsten, is welded to a leading end portion 21 of the center electrode 20 in such a manner as to be integral with the center electrode 20. In addition, in this embodiment, the center electrode 20 and the electrode chip 25, which is made integral with the center electrode 20, are referred to as the "center electrode." This electrode chip 25 can be omitted from the construction of the center electrode 20.

A rear end side of the center electrode 20 is diametrically expanded into a collar-like configuration. This collar-shaped portion is brought into abutment with a stepped portion which configures a starting point of the electrode accommodating portion 15 within the axial hole 12, whereby the center electrode 20 is positioned within the electrode accommodating portion 15. In addition, a circumferential edge of a leading end face 26 of the leading end portion 21 of the center electrode 20 (more specifically, the leading end face 26 of the electrode chip 25) is in abutment with a stepped portion between the electrode accommodating portion 15 and the leading end smallest diameter portion 16 which have different diameters. By this configuration, a cavity 60 (hereinafter, also referred to as a "cavity" from time to time) which has a small capacity is formed so as to be surrounded by an inner circumferential surface of the leading end smallest diameter portion 61 of the axial hole 12 and the leading end face 26 of the center electrode 20. Spark discharge performed in as park discharge gap between the ground electrode 30 and the center electrode 20 passes a space within the cavity 60 and a wall surface thereof. Then, plasma is formed within the cavity 60 by energy applied after a dielectric break down has been occurred. The plasma so formed is ejected from an open end 11 of the opening 14.

As shown in FIG. 1, the center electrode 20 is electrically connected to the rear end side metal terminal casing 40 by way of a conductive seal material 4 which is made of a mixture of metal and glass and is provided in the interior of the axial hole 12. The center electrode 20 and the metal terminal casing 40 are fixed in place and are made to communicate electrically with each other within the axial hole 12 by the seal material 4. A high tension cable which is connected to an ignition control device via a plug cap is connected to the metal terminal casing 40.

The metal shell 50 is a cylindrical metal casing for fixing the ignition plug 100 to an engine head of an internal combustion engine. Metal shell 50 holds the ignition plug 100 so as to surround the porcelain insulator 10. The metal shell 50 is formed of an iron-based material and includes a tool engagement portion 51 on which a plug wrench is fitted and a thread portion 52 which is threaded into the engine head provided on the internal combustion engine.

A crimped portion 53 is provided on the metal shell 50 in a position lying further towards the rear end side than the tool engagement portion 51. Annular ring members 6, 7 are interposed between the a portion of the metal shell 50 extending from the tool engagement portion 51 to the crimped portion 53 and the rear end body portion 18 of the porcelain insulator 10. A powder of talc 9 is loaded between the ring members 6, 7. By this crimped portion 53 being crimped, the porcelain insulator 10 is pressed towards the leading end side within the metal shell 50 via the ring members 6, 7 and the talc 9. By this action, as shown in FIG. 2, the stepped portion between the extended leg portion 13 and the leading end side body portion 17 is supported on a locking portion 56 which is formed into a stepped-like portion on an inner circumferential surface of the metal shell 50 via an annular packing 80. As a result, the metal shell 50 and the porcelain insulator 20 are integrally assembled together. Gas-tightness is held between the metal shell 50 and the porcelain insulator 10 by the packing 80 whereby the leakage of combustion gases is prevented. In addition, as shown in FIG. 1, a collar portion 54 is formed between the tool engagement portion 51 and the thread portion 52. A gasket 5 is fitted on the metal shell 50 in a position lying in the vicinity of a rear end side of the thread portion 52 or on a seat surface 55 of the collar portion 54.

The ground electrode 30, which is 1 mm thick and is formed into a plate shape, is provided at the leading end portion 59 of the metal shell 50. The ground electrode 3 has a structure in which a ring-shaped noble metal member 36, in which a through hole is formed, is joined to a center of an electrode base material 33 which is made of a nickel-based alloy by laser welding. The noble metal member 36 can be formed of an Ir alloy in which platinum (Pt), rhodium (Rh), ruthenium (Ru) palladium (Pd), rhenium (Re) or the like is added to iridium (Ir), which comprises a main constituent. In addition, the noble metal member 36 can also be formed of an alloy in which iridium (Ir), rhodium (Rh), ruthenium (Ru), palladium (Pd), rhenium (Re) or the like is added to platinum, which comprises a main constituent.

As shown in FIG. 2, the ground electrode 30 is disposed such that its thickness direction is aligned with the direction of the axis O. Ground electrode 30 is fitted in a fitting stepped portion 58 which is formed on an inner circumferential surface of the leading end portion 59 of the metal shell 50. In addition, an outer circumferential edge of the ground electrode 30 is laser welded to the fitting stepped portion 58 along a full circumference thereof whereby the ground electrode 30 is joined integrally with the metal shell 50. Note that an outer circumference of the ground electrode 30 is formed slightly smaller than an inner circumference of the fitting stepped portion 58. Because of this, the ground electrode 30 is loosely fitted in the fitting stepped portion 58 and thereafter, the laser welding is implemented. In addition, the through hole 31 of the ground electrode 30 is formed such that its inside diameter is equal to or larger than at least an inside diameter of the opening 14 (the open end 11) of the porcelain insulator 10, so that an interior of the cavity 60 is made to communicate with the outside air via this through hole 31.

In the ignition plug 100 that is configured as has been described heretofore, when an air-fuel mixture is ignited, firstly, a high voltage is applied between the center electrode 20 and the ground electrode 30 so as to implement spark discharge. A current is allowed to flow between the center electrode 20 and the ground electrode 30 at a relatively low voltage by the dielectric breakdown generated when the spark is discharged. Then, by electric power being supplied further between the center electrode 20 and the ground electrode 30, a transition of discharging state is produced, so as to form plasma within the cavity 60. The plasma so formed is then ejected through the through hole 31 (so-called orifice) to thereby ignite the air-fuel mixture.

B. First Exemplary Embodiment

Figure 3:
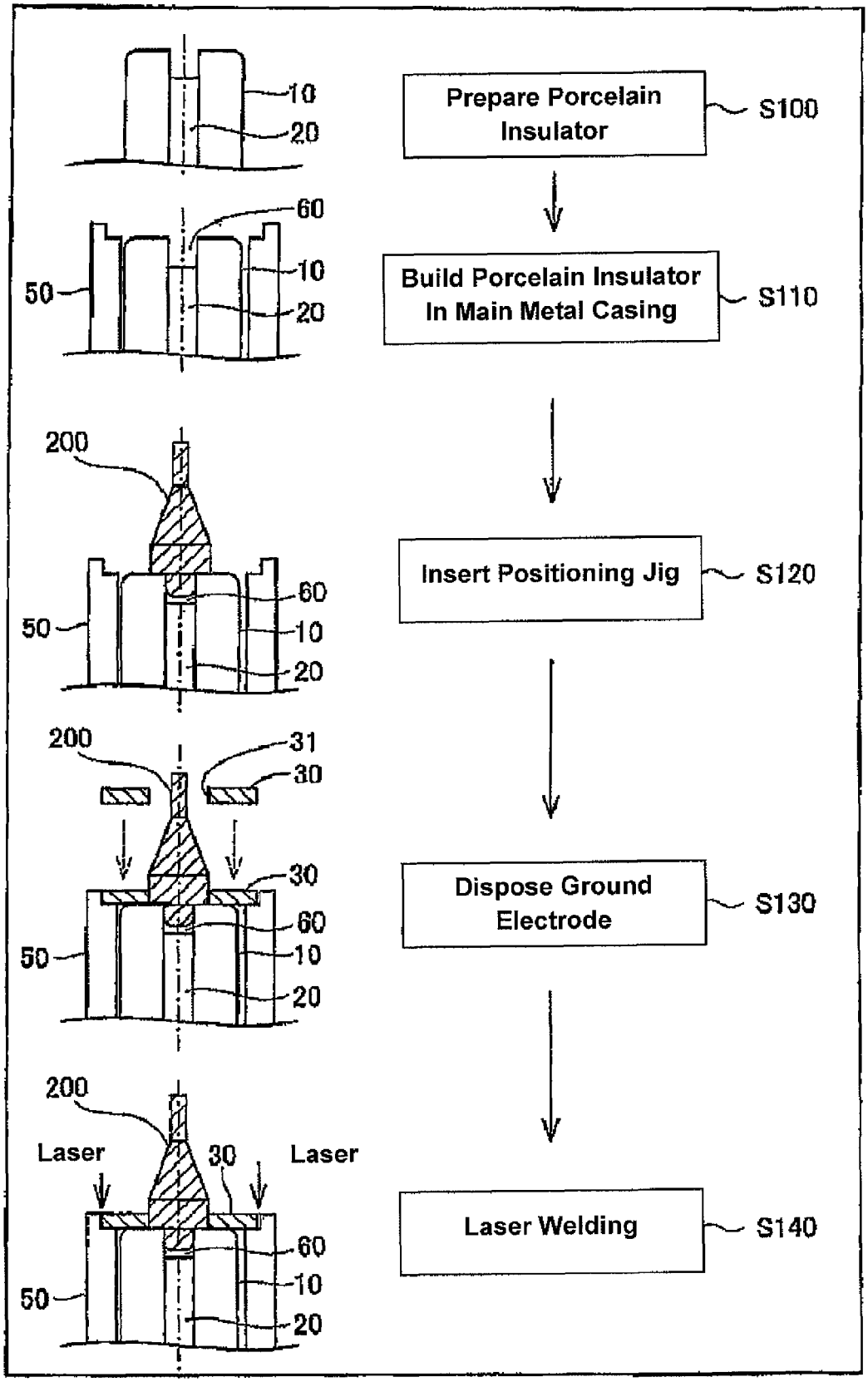
FIG. 3 is a diagram showing an ignition plug manufacturing method as a first exemplary embodiment.

FIG. 3 is a diagram showing an ignition plug manufacturing method according to a first exemplary embodiment of the invention. As shown in FIG. 3, in this embodiment, firstly, a porcelain insulator 10, in which a center electrode 20 is assembled in advance, is prepared in a separate manufacturing step (step S100: a preparation step). Then, the porcelain insulator 10 is inserted into a metal shell 50, and by a crimped portion 53 of the metal shell 50 being crimped, the porcelain insulator 10 is built in the metal shell 50 (step S110: a build-in step). In addition, a predetermined positioning jig 200 is inserted into a cavity 60 (a cavity 60) provided at a leading end of the porcelain insulator 10 (step S120: a positioning step).

Figure 4:
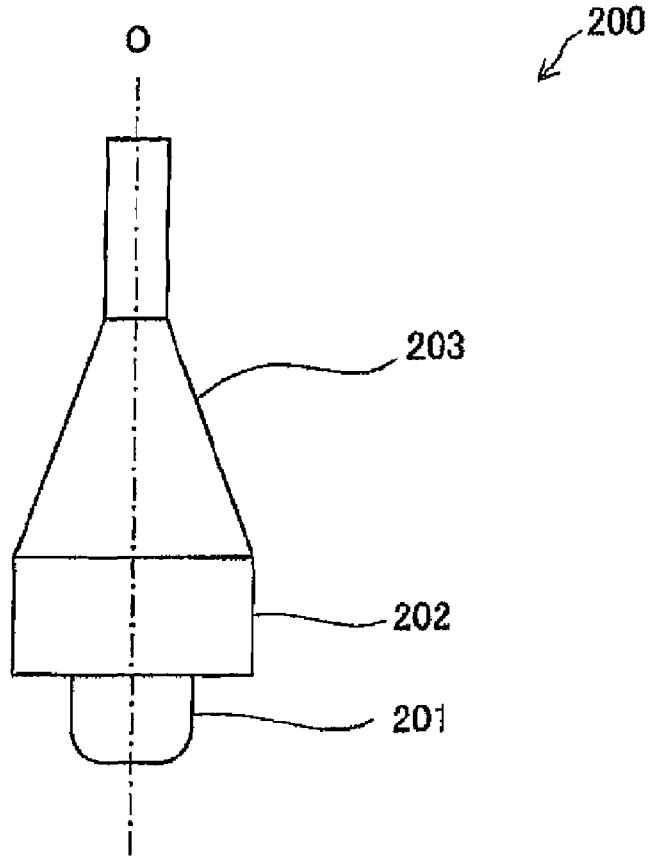
FIG. 4 is a side view of a positioning jig 200.
Figure 5:
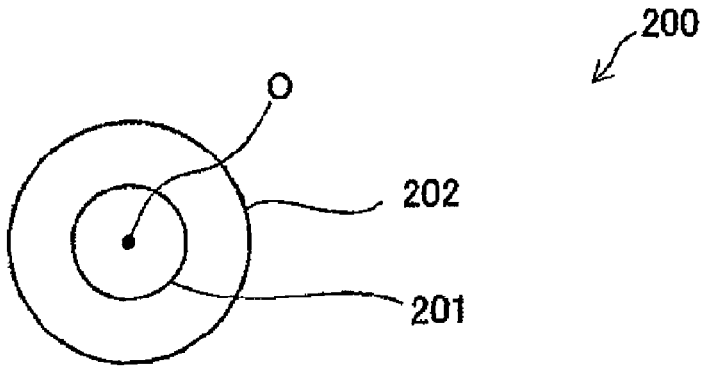
FIG. 5 is a bottom view of the positioning jig 200.

FIG. 4 is a side view of the positioning jig 200, and FIG. 5 is a bottom view of the positioning jig 200 as viewed from a rear end side of an axis O thereof. As shown in FIG. 4, the positioning jig 200 has a head portion 201, a body portion 202, and a leg portion 203. As shown in FIG. 5, the head portion 201 and the body portion 202 are formed into a cylindrical shape, and their center axes reside on the same axis. The diameter of the head portion 201 has such a dimension that the head portion 201 fits in a cavity 60 of the porcelain insulator 10. In this embodiment, for easy insertion of the head portion 201 into the cavity 60 of the porcelain insulator 10, a rear end corner portion of the head portion 201 is chamfered. On the other hand, the diameter of the body portion 202 has such a dimension that the body portion 202 fits in the through hole 31 of the ground electrode 30. As shown in FIGS. 4 and 5, because the diameter of the body portion 202 is larger than the diameter of the head portion 201, a stepped portion residing at a boundary between the body portion 202 and the head portion 201 is formed. The head portion 201 and stepped portion interact with the leading end face of the porcelain insulator 10 in a locking fashion, whereby the insertion position of the positioning jig 200 relative to the porcelain insulator 10 in the axial direction is fixed. The leg portion 203 is formed such that a rear end side outer circumference thereof coincides with that of the body portion 202, while the leg portion 203 is continuously reduced in diameter towards a leading end thereof in a tapered fashion. The positioning jig 200 can be formed from, by way of example and not limitation, a resin material.

Following insertion of the head portion 201 of the positioning jig 200 into the cavity 60 in step S120 above, the ground electrode 30, to which a noble metal member 36 having a through hole 31 is joined in advance, is moved down over the positioning jig 200 from a leg portion 203 side thereof, so that the ground electrode 30 is placed in a fitting stepped portion 58 which is provided at the leading end portion of the metal shell 50 (step S130: a disposing step+a positioning step). In this embodiment, as shown in FIG. 4, because the leg portion 203 of the position jig 200 is formed into the tapered shape, the ground electrode 30 can easily be placed in position in the fitting stepped portion 58.

After the ground electrode 30 is placed in the fitting stepped portion 58 in the leading end portion of the metal shell 50 in step S130, a boundary portion between an outer circumference of the ground electrode 30 and the fitting stepped portion 58 of the metal shell 50 is laser welded along a full circumference thereof (step S140: a welding step). The ignition plug 100 shown in FIG. 1 is completed by performing the series of steps described heretofore.

In the manufacturing method of the first exemplary embodiment that has been described heretofore, the ground electrode 30 having the through hole 31 is moved down onto the body portion 202 of the positioning jig 200 when the head portion 201 of the positioning jig 200 is inserted in the cavity 60 (the cavity 60) at the leading end of the porcelain insulator 10, so as dispose the ground electrode 30 in place. Since the center axes of the head portion 201 and the body portion 202 of the positioning jig 200 reside on the same axis, when the ground electrode 30 is disposed at the leading end of the metal shell 50 while the head portion 201 of the positioning jig 200 is inserted in the cavity 60, the center of the through hole 31 and the center of the cavity 60 are automatically positioned on the same axis. Because of this, in the build-in step (step S110 described above) of building the porcelain insulator 10 in the metal shell 50, even though a shift in position or a position error occurs between the center axis of the porcelain insulator 10 and the center axis of the metal shell 50, the ground electrode 30 is made to be joined to the metal shell 50 so as to compensate for the shift. Consequently, according to this embodiment, the occurrence of a partial wear of the ground electrode 30 and a quenching action, which would otherwise be caused if the center axis of the cavity 60 does not coincide with the center axis of the through hole 31, can be suppressed. As a result, it becomes possible to manufacture the ignition plug 100 which has intended durability and ignitability.

C. Second Exemplary Embodiment

Figure 6:
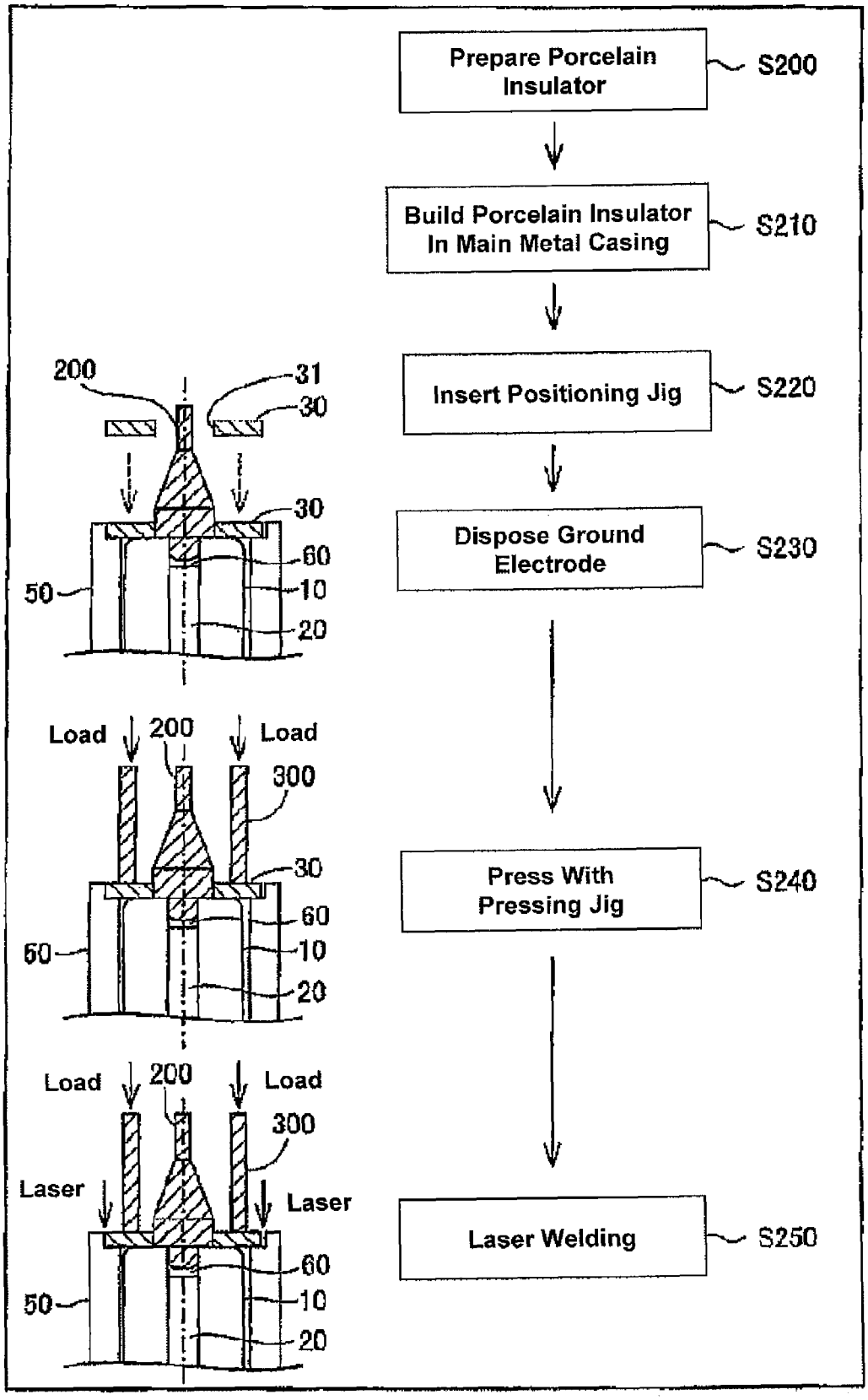
FIG. 6 is a diagram showing an ignition plug manufacturing method as a second exemplary embodiment.

FIG. 6 is a diagram showing an ignition plug manufacturing method according to a second exemplary embodiment of the invention. As shown in FIG. 6, in this embodiment, steps S100 to S130 which were described in the first exemplary embodiment above, are performed. In this respect, a porcelain insulator 10, in which a center electrode 20 is assembled, is prepared (step S200: a preparation step). The porcelain insulator 10 so prepared is assembled in a metal shell 50 (step S210: a build-in step). A positioning jig 200 is inserted in a cavity 60 at a leading end of the porcelain insulator 10 (step S220: a positioning step). Then, a ground electrode 30 having a through hole 31 is moved down onto the positioning jig 200 from a leg portion 203 side thereof, so that the ground electrode 30 is placed in a fitting stepped portion 58 at a leading end of the metal shell 50 (step S230: a disposing step+a positioning step).

Following this, according to this embodiment, a predetermined pressing jig 300 is placed on the ground electrode 30, which is placed in the fitting stepped portion 58, so as to apply a load on to the ground electrode 30 to thereby press the ground electrode 30 towards the metal shell 50 side (step S240). This load is controlled so that the ground electrode 30 is not deformed and that the ground electrode 30 is prevented from being shifted in its position by impact generated when the laser welding is implemented. The load is generally on the order of 0.1 kN to 3 kN (preferably, 1 kN for a ground electrode 30 which is 1 mm thick).

Figure 7:
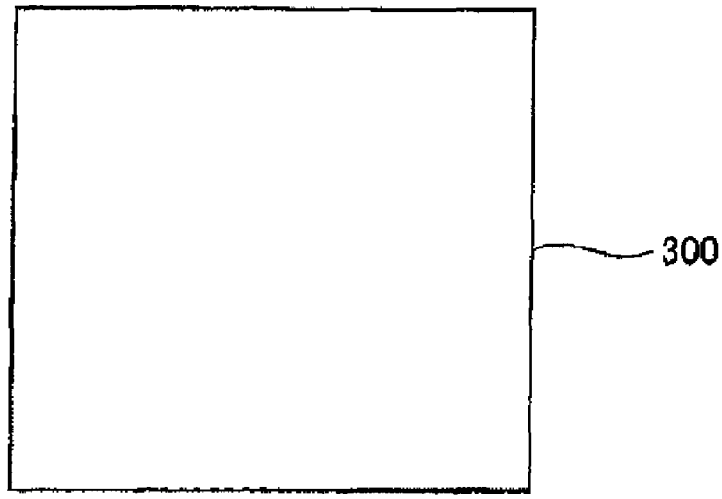
FIG. 7 is a side view of a pressing member 300.
Figure 8:
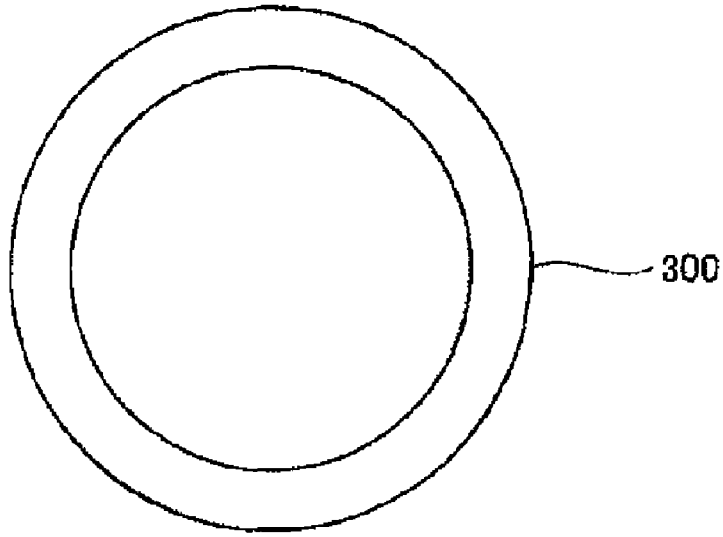
FIG. 8 is a bottom view of the pressing member 300.

FIG. 7 is a side view of the pressing jig 300, and FIG. 8 is a bottom view of the pressing jig 300 as viewed from a rear end side of an axis O. As shown in these figures, the pressing jig 300 has a substantially cylindrical shape, and an outside diameter thereof is formed smaller than an outside diameter of the ground electrode 30 and an inside diameter thereof is formed larger than an inside diameter of the through hole 31. The pressing jig 300 is formed from, by way of example and not limitation, a resin material.

With the ground electrode 30 held in place by the pressing jig 300 in step S240 above, a boundary portion between an outer circumference of the ground electrode 30 and the fitting stepped portion 58 of the metal shell 50 is laser welded along a full circumference thereof (step S250: a welding step). The ignition plug 100 shown in FIG. 1 is completed by performing the series of steps described above.

In the manufacturing method of the second exemplary embodiment that has been described above, after the position of the ground electrode 30 is determined by the positioning jig 200, the ground electrode 30 is pressed against by the pressing jig 300, whereby the disposing position of the ground electrode 30 is fixed. Because of this, separation of the ground electrode 30 from the metal shell 50, which might otherwise be caused by the impact generated when the laser welding is implemented, can be suppressed. In addition, in the manufacturing steps that have been described above, after the disposing position of the ground electrode 30 has been fixed by the pressing jig 300, the positioning jig 200 may be made to be removed from the cavity 60.

D. Third Exemplary Embodiment

Figure 9:
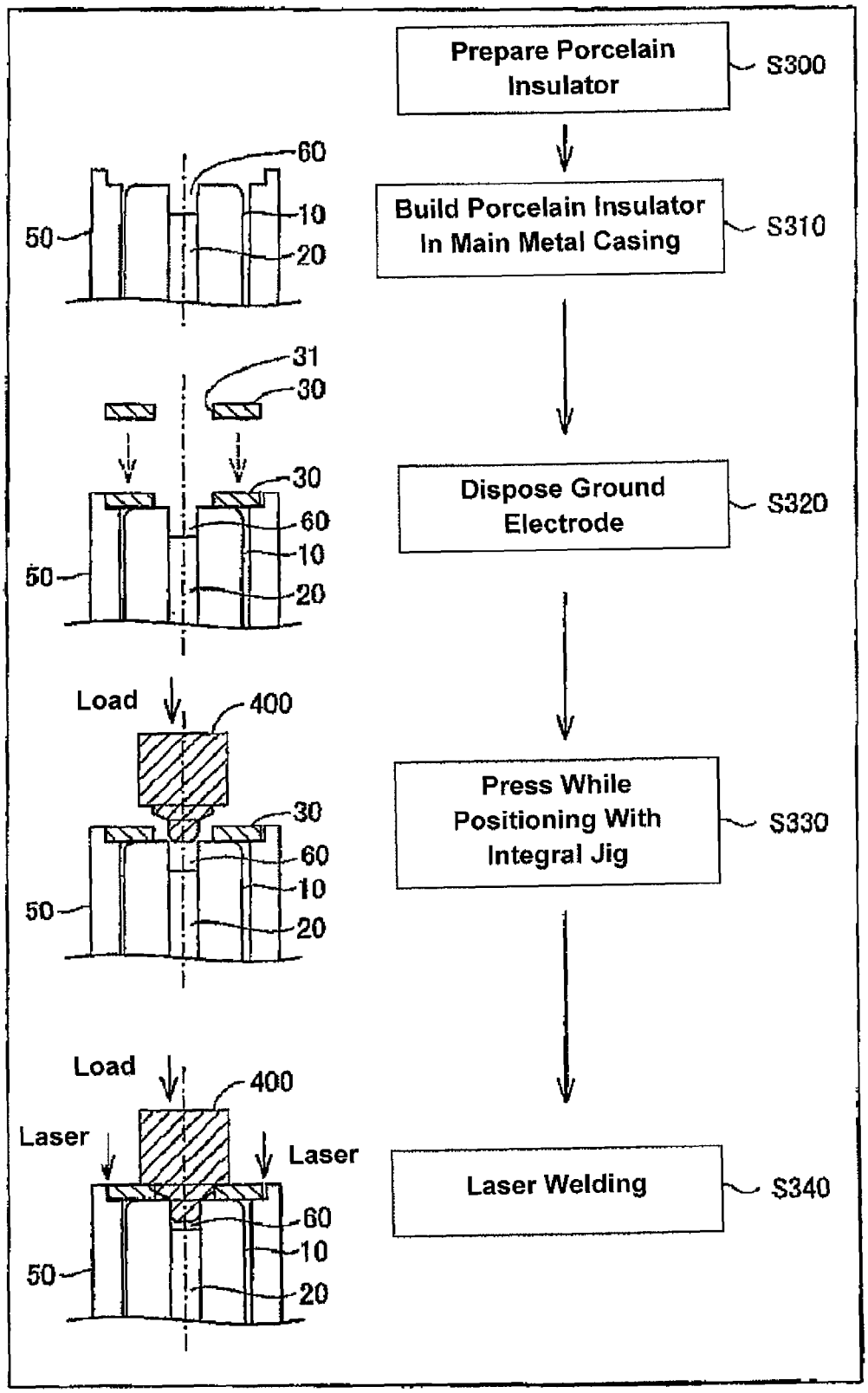
FIG. 9 is a diagram showing an ignition plug manufacturing method as a third exemplary embodiment.

FIG. 9 is a diagram showing an ignition plug manufacturing method according to a third exemplary embodiment of the invention. As shown in FIG. 9, in this embodiment, firstly, similar to steps S100, S110 which were described in the first exemplary embodiment above, a porcelain insulator 10 in which a center electrode 20 is assembled is prepared (step S300: a preparation step) and the porcelain insulator 10 so prepared is then assembled in a metal shell 50 (step S310: a build-in step).

Following this, in this embodiment, a ground electrode 30 is placed in a fitting stepped portion 58 in a leading end of the metal shell 50 (step S320: a disposing step). Then, an integral jig 400, which doubles as both the positioning jig 200 illustrated in the first exemplary embodiment and the pressing jig 300 illustrated in the second exemplary embodiment, is fitted in a cavity 60 at a leading end of the porcelain insulator 10 and a through hole 31 of the ground electrode 30. A load is applied to the ground electrode 30, whereby the ground electrode 30 is pressed towards the metal shell 50 side (step S330: a positioning step). This load is the same load as that described in the second exemplary embodiment.

Figure 10:
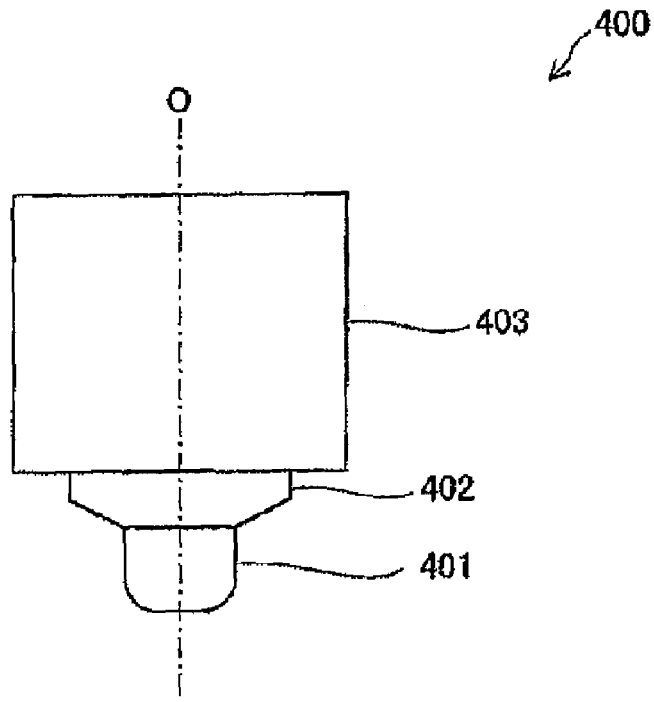
FIG. 10 is a side view of an integral jig 400.
Figure 11:
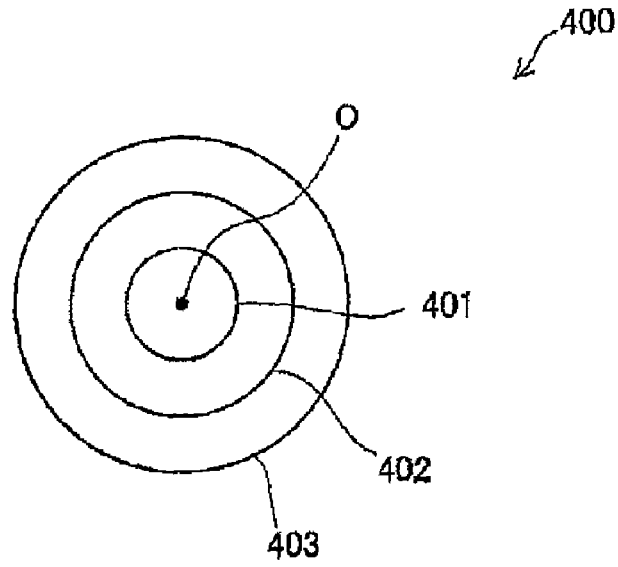
FIG. 11 is a bottom view of the integral jig 400.

FIG. 10 is a side view of the integral jig 400, and FIG. 11 is a bottom view of the integral jig 400 as viewed from a rear end side of an axis O. As shown in FIG. 10, the integral jig 400 includes a head portion 401, a body portion 402 and a pressing portion 403. As shown in FIG. 11 the head portion 401, the body portion 402 and the pressing portion 403 are each formed into a substantially cylindrical shape, and central axes thereof reside on the same axis. The head portion 401 is dimensioned to fit in the cavity 60 at the leading end of the porcelain insulator 10. The body portion 402 is dimensioned to fit in the through hole 31 of the ground electrode 30. An axial thickness of the body portion 402 is the same as the thickness of the ground electrode 30. The diameter of the pressing portion 403 is formed to be larger than the diameter of the body portion 402 and smaller than the diameter of the ground electrode 30. According to the construction just described, in step S330, the load is applied to the ground electrode 30 by the pressing portion 403 which has the diameter described above. In addition, in this embodiment, for easy insertion of the head portion 401 of the integral jig 400 into the cavity 60, a rear end corner portion of the head portion 401 is chamfered. In addition, in order for the body portion 402 to be inserted fittingly in the through hole 31 of the ground electrode 30 in a smooth fashion, a "head portion 401" side of the body portion 402 is made to be reduced in diameter continuously towards its end in a tapered fashion. In place of the "head portion 401" side of the body portion 402 being formed into the tapered shape, a corner portion may be chamfered. The integral jig 400 may be formed from, by way of example and not limitation, a resin material.

With the load applied to the ground electrode 300 by the use of the integral jig 400 in step S330 above, a boundary portion between an outer circumference of the ground electrode 30 and the fitting stepped portion 58 of the metal shell 50 is laser welded along a full circumference thereof (step S340: a welding step) while the ground electrode 300 is held in that position. The ignition plug 100 shown in FIG. 1 is completed by performing the series of steps described above.

According to the third exemplary embodiment that has been described above, by the use of the integral jig 400, the load can be applied to the ground electrode 30 at the same time as the center of the cavity 60 and the center of the through hole 31 are aligned with each other. Consequently, the ignition plug 100 can easily be manufactured.

E. Fourth Exemplary Embodiment

Figure 12:
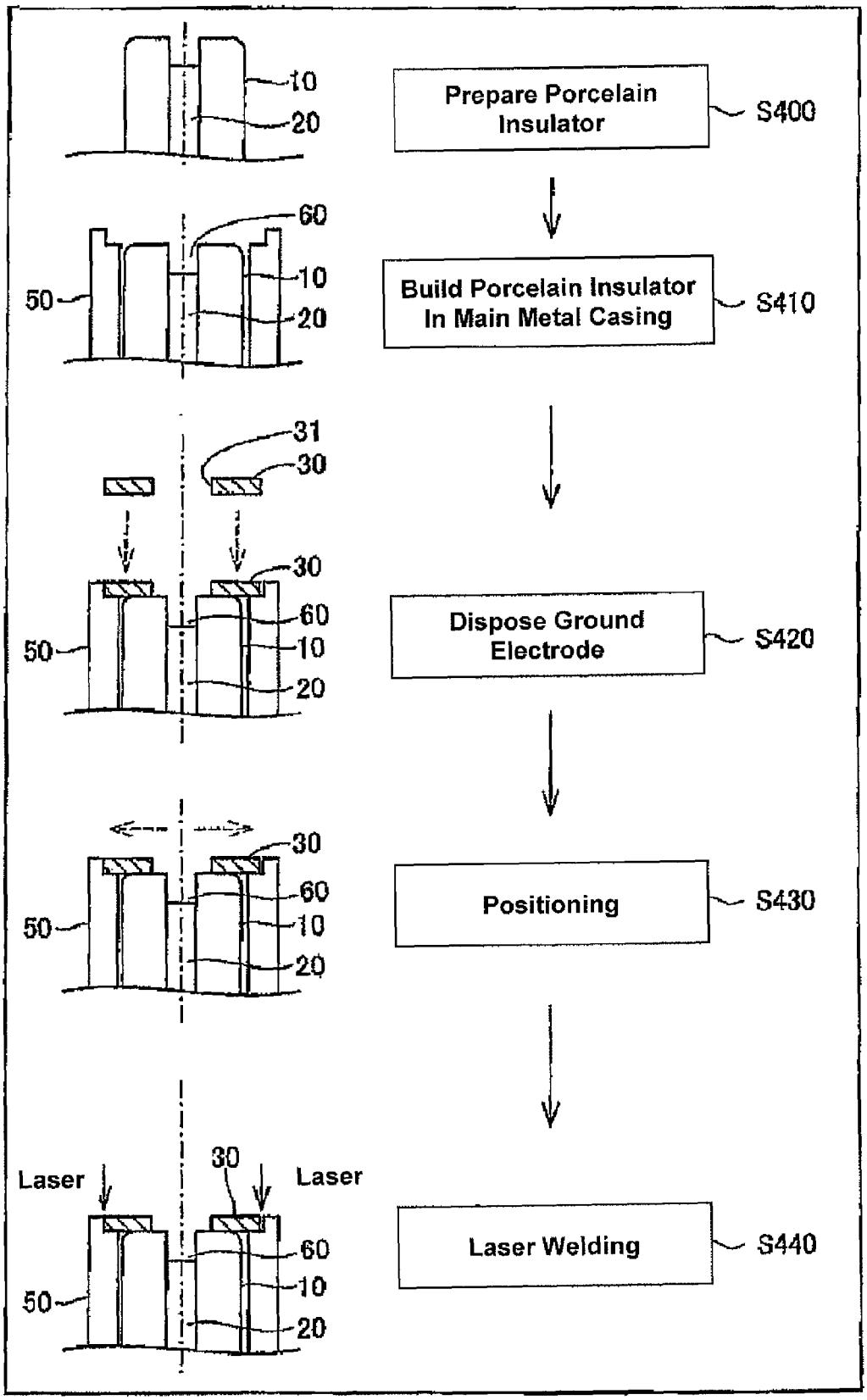
FIG. 12 is a diagram showing an ignition plug manufacturing method as a fourth exemplary embodiment.

FIG. 12 is a diagram showing a plasma-jet manufacturing method according to a fourth exemplary embodiment of the invention. As shown in FIG. 12, in this embodiment, firstly, similar to steps S100, S110 which were described in the first exemplary embodiment above, a porcelain insulator 10 in which a center electrode 20 is assembled is prepared (step S400: a preparation step) and the porcelain insulator 10 is assembled in a metal shell 50 (step S410: a build-in step).

Following this, in this embodiment, a ground electrode 30 is placed in a fitting stepped portion 58 provided at a leading end of the metal shell 50 (step S420: a disposing step). The ground electrode 30 is made to be positioned relative to the metal shell 50 such that the center of a cavity 60 and a center of a through hole 31 in the ground electrode 30 coincide with each other. This positioning can be implemented visually, for example. Lastly, a boundary portion between an outer circumference of the ground electrode 30 and the fitting stepped portion 58 of the metal shell 50 are laser welded along a full circumference thereof (step S440: a welding step). The ignition plug 100 shown in FIG. 1 is completed by performing the series of steps described above.

Also, by the fourth exemplary embodiment that has been described above, the ignition plug 100 can be manufactured after the center of the cavity 60 and the center of the through hole 31 in the ground electrode 30 have been aligned. Note that in step S440, which is the welding step, by the use of the pressing jig 300 illustrated in the second embodiment, the laser welding may be made to be implemented while applying the load to the ground electrode 30.

F. Fifth Exemplary Embodiment

Figure 13:
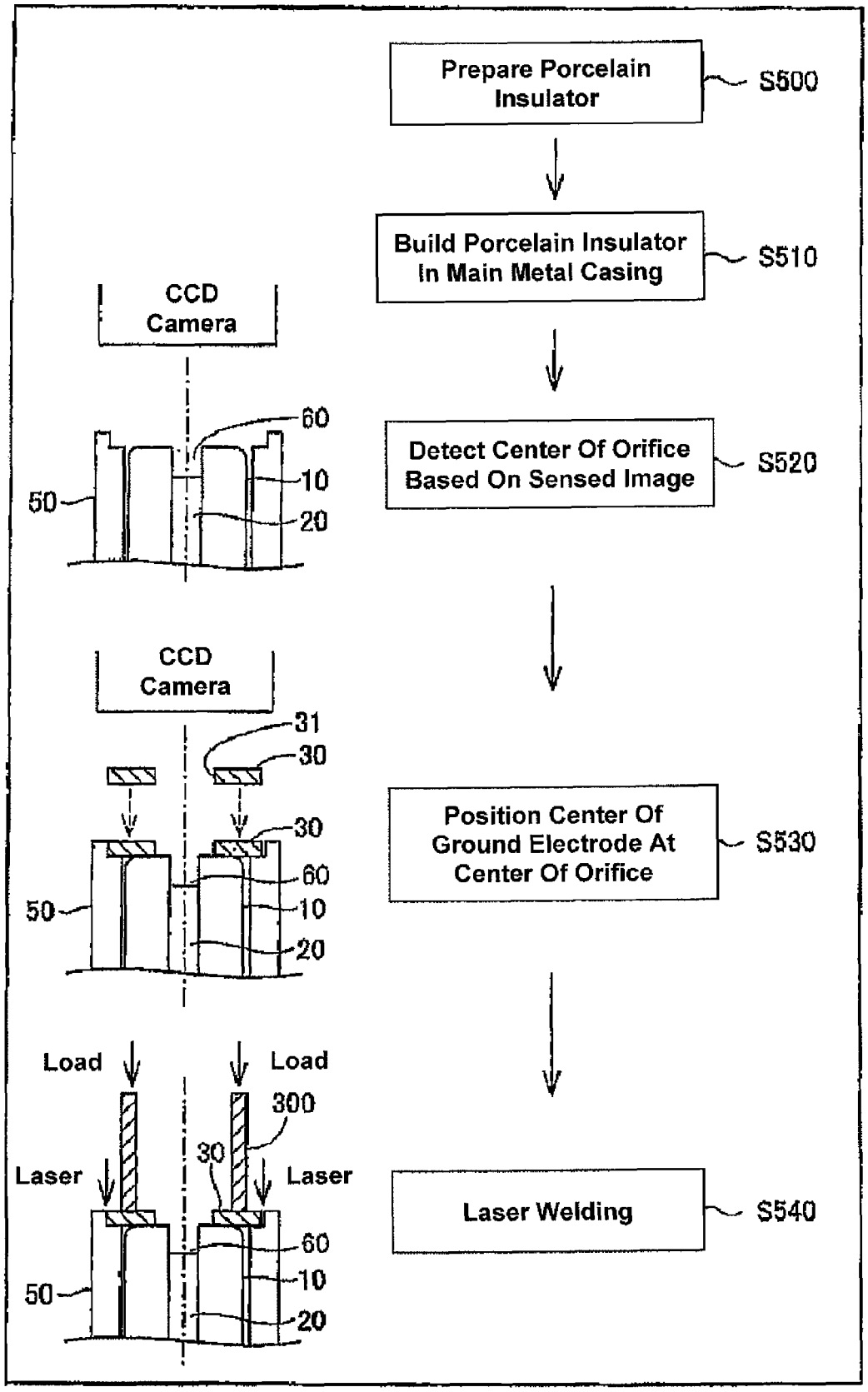
FIG. 13 is a diagram showing an ignition plug manufacturing method as a fifth exemplary embodiment.

FIG. 13 is an ignition plug manufacturing method according to a fifth exemplary embodiment of the invention. As shown in FIG. 13, in this embodiment, firstly, similar to steps S100, S100 which were described in the first exemplary embodiment above, a porcelain insulator 10 in which a center electrode 20 is assembled is prepared (step S500: a preparation step), and the porcelain insulator 10 so prepared is assembled in a metal shell 50 (step S510: a build-in step).

Following this, in this embodiment, an image (a picture) including a cavity 60 is sensed from a leading end side of an ignition plug 100 by a sensing apparatus such as a CCD (Charged Coupled Device) camera at the stage where the porcelain insulator 10 is assembled in the metal shell 50. Then, the sensed image is read by a computer so as to detect a center of the cavity 60 by a known image analyzing technique (step S520: a detecting step). In this detecting step, for example, the computer performs an edge extracting operation on the sensed image so as to extract a contour of the cavity 60, detects a circle from the contour so extracted by a method such as pattern matching or Hough transformation and obtains a center of the circle so detected to thereby detect a center of the cavity 60.

When the center of the cavity 60 is detected, a ground electrode 30 is placed at a leading end portion of the metal shell 50 to be positioned such that a center of a through hole 31 in the ground electrode 30 is positioned at, i.e., aligned with, the center of the cavity 60 (step S530: a disposing step+a positioning step). In this step, for example, the center of the cavity 60 detected in step S520 is displayed on a monitor of the computer, and the center of the through hole 31, which is detected in the same method that was used to detect the center of the cavity 60, is also displayed on the monitor. Then, by the ground electrode 30 being placed at the leading end portion of the metal shell 50 such that those centers overlap each other on the monitor, the positioning of the ground electrode 30 relative to the metal shell 50 is implemented. This positioning operation may be implemented by an operating person while verifying the image shown on the monitor or by a working robot connected to the computer which automatically shifts the ground electrode 30.

When the positioning has been implemented in the way described above, a boundary portion between an outer circumference of the ground electrode 30 and a fitting stepped portion 58 of the metal shell 50 is laser welded around a full circumference thereof (step S540: a welding step). As this occurs, in the event that the laser welding is implemented by the ground electrode 30 being pressed against the metal shell 50 by a pressing jig 300, the ground electrode 30 can be joined onto the metal shell 50 with good accuracy. By performing the series of steps described above, the ignition plug shown in FIG. 1 is completed.

According to the fifth exemplary embodiment that has been described heretofore, the center of the cavity 60 is detected by analyzing the image sensed by the sensing apparatus. Because of this, the center of the cavity 60 and the center of the through hole 31 can be positioned without applying a physical load to the cavity 60 and the periphery thereof.

G. Sixth Exemplary Embodiment

Figure 14:
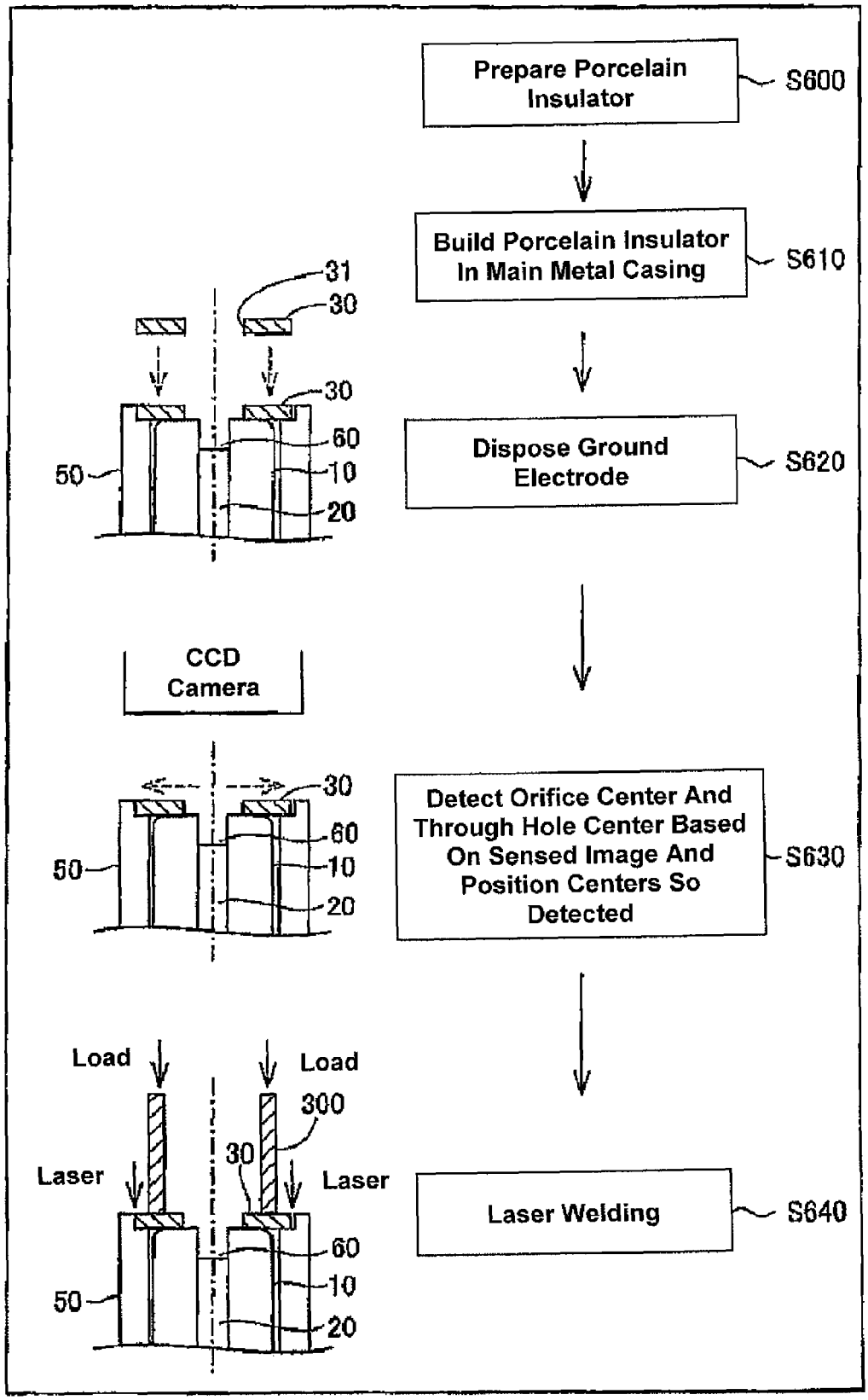
FIG. 14 is a diagram showing an ignition plug manufacturing method as a sixth exemplary embodiment.

FIG. 14 is a diagram showing an ignition plug manufacturing method according to a sixth exemplary embodiment of the invention. As shown in FIG. 14, in this embodiment, firstly, similar to steps S100, S110 which were described in the first exemplary embodiment above, a porcelain insulator 10 in which a center electrode 20 is assembled is prepared (step S600: a preparation step), and the porcelain insulator 10 so prepared is assembled in a metal shell 50 (step S610: a build-in step).

Following this, in this embodiment, a ground electrode 30 is disposed at a leading end portion of the metal shell 50 (step S620: a disposing step), and in this position, an image including a cavity 60 and a through hole 31 in the ground electrode 30 are sensed from a leading end side of an ignition plug 100 by a sensing apparatus. Then, the image so sensed is read by a computer, so as to detect a center of the cavity 60 and a center of the through hole 31 by the same method as that used in the fifth exemplary embodiment. At the same time, these center positions are caused to coincide with each other to position the ground electrode 30 relative to the metal shell 50 (step S630: a detecting step+a positioning step). In this step, as with the fifth exemplary embodiment, this positioning operation may be implemented by an operating person while verifying the image shown on the monitor or by a working robot connected to the computer.

When the positioning has been implemented in the way described above, a boundary portion between an outer circumference of the ground electrode 30 and a fitting stepped portion 58 of the metal shell 50 is laser welded around a full circumference thereof (step S640: a welding step). As this occurs, in the event that the laser welding is implemented by the ground electrode 30 being pressed against the metal shell 50 by a pressing jig 300, the ground electrode 30 can be joined onto the metal shell 50 with good accuracy. By performing the series of steps described above, the ignition plug shown in FIG. 1 is completed.

According to the sixth exemplary embodiment that has been described heretofore, the center of the cavity 60 and the center of the through hole 31 are detected by analyzing the image sensed by the sensing apparatus. At the same time, the positioning of the ground electrode 30 relative to the cavity 60 or the metal shell 50 is implemented. Because of this, the center of the cavity 60 and the center of the through hole 31 can be positioned with good efficiency.

H. Modified Examples

Thus, while the various embodiments of the invention have been described heretofore, the invention is not limited to those embodiments, and, the invention can adopt various configurations without departing from the spirit and scope thereof. For example, the following modifications are possible.

Figure 15:
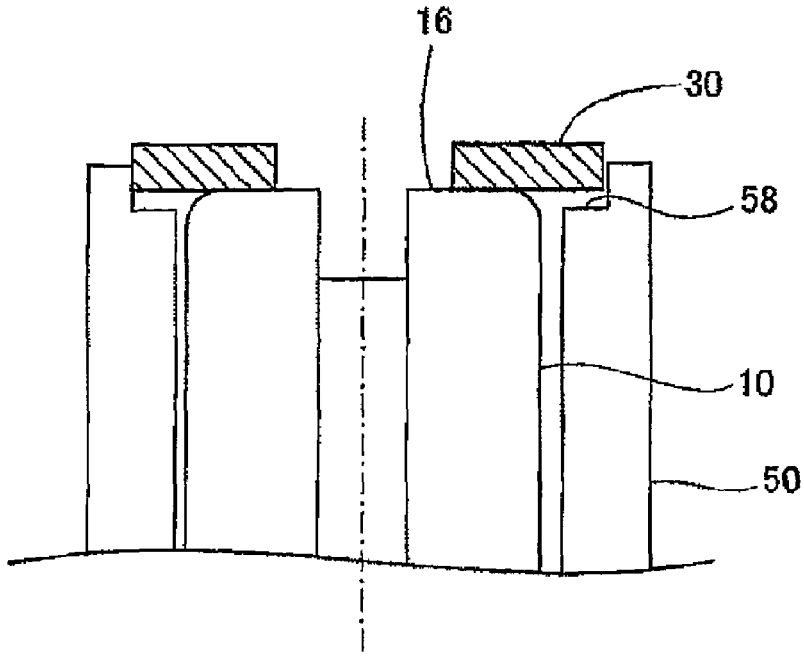
FIG. 15 is a diagram showing an example in which a porcelain insulator 10 projects further than a fitting stepped portion 58.
Figure 16:
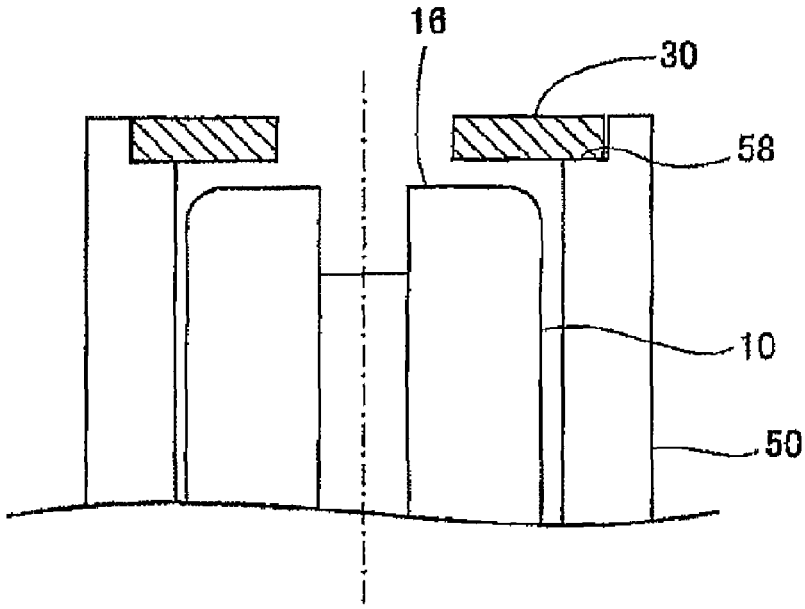
FIG. 16 is a diagram showing an example in which the porcelain insulator 10 subsides lower than a bottom portion of the fitting stepped portion 58.

In the structure of the ignition plug 100 shown in FIG. 2, the ground electrode 30 is in abutment with both the leading end face 16 of the porcelain insulator 10 and the fitting stepped portion 58. However, when the porcelain insulator 10 is built in the metal shell 50, due to the effects of dimension tolerance and build-in tolerance of the components, there occurs a case where the leading end face 16 of the porcelain insulator 10 projects further or subsides lower than the fitting stepped portion 58. FIG. 15 shows an example where the porcelain insulator 10 projects further than the fitting stepped portion 58. FIG. 16 shows an example where the porcelain insulator 10 subsides lower than a bottom portion of the fitting stepped portion 58. However, even though the ground electrode 30 is in abutment with neither the leading end face 16 of the porcelain insulator 10 nor the fitting stepped portion 58, according to the various embodiments that have been described heretofore, by the use of the positioning jig 200 and the integral jig 400, the center of the cavity 60 and the center of the through hole 31 can be positioned on the same axis.

In the respective embodiments that have been described heretofore, the ground electrode 30 is fitted in the fitting stepped portion 58 formed at the leading end of the metal shell 50 and thereafter, the laser welding is implemented around the boundary between the ground electrode 30 and the metal shell 50. However, various embodiments can be adopted as joining methods of the ground electrode 30 to the metal shell 50.

Figure 17:
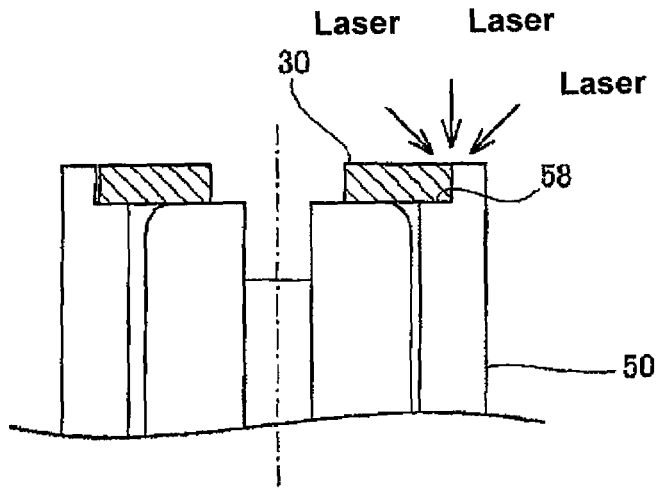
FIG. 17 is a diagram showing a variation of a method for joining the ground electrode 30 to a metal shell 50.
Figure 18:
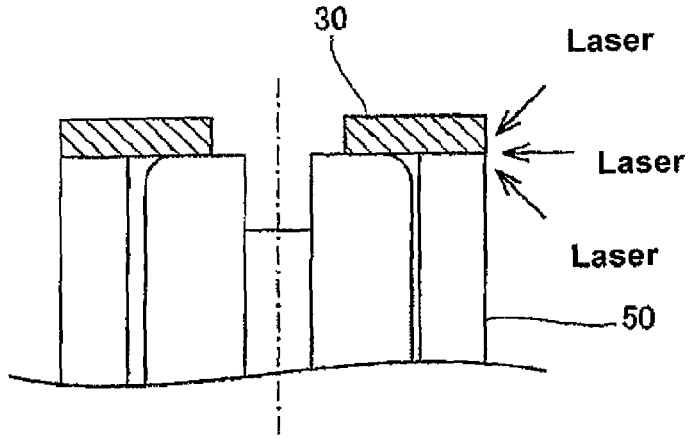
FIG. 18 is a diagram showing another variation of a method for joining the ground electrode 30 to the metal shell 50.
Figure 19:
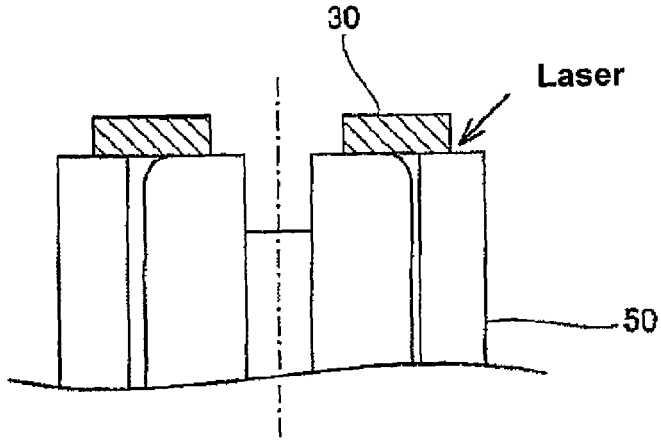
FIG. 19 is a diagram showing a further variation of a method for joining the ground electrode 30 to the metal shell 50.

FIGS. 17 to 19 are diagrams showing variations of joining methods for joining the ground electrode 30 to the metal shell 50. FIG. 17 shows variations of directions in which the laser welding is implemented. As shown in the figure, when the ground electrode 30 is joined to the fitting stepped portion 58 of the metal shell 50, the laser welding may be made to be implemented at right angles to the boundary between the ground electrode 30 and the metal shell 50 or the laser welding may be made to be implemented obliquely towards the boundary between the ground electrode 30 and the metal shell 50 from an outside of the metal shell 50. Alternatively, the laser welding may be made to be implemented obliquely towards the boundary between the ground electrode 30 and the metal shell 50 from an inside of the metal shell 50.

FIG. 18 shows an example in which a leading end of a metal shell 50 is formed into something like a flat surface, and a ground electrode 30 having the same diameter as the diameter of the metal shell 50 is placed on the flat surface. In this case, a laser welding is implemented at right angles to a boundary where the ground electrode 30 is in abutment with the metal shell 50 from an outside of the metal shell 50 so as to join them together. In addition, in this case, the laser welding can be implemented obliquely to the boundary where the ground electrode 30 is in abutment with the metal shell 50 from the ground electrode 30 side or from the metal shell 50 side.

FIG. 19 shows an example where a leading end of a metal shell 50 is formed into something like a flat surface, and a ground electrode 30 having a smaller diameter than that of the metal shell 50 is placed on the flat surface. In this case, a laser welding is implemented obliquely to a boundary between the ground electrode 30 and the metal shell 50 from an outside of the metal casing so as to join them together.

In addition, in the respective embodiments that have been described heretofore, while the ground electrode 30 and the metal shell 50 are joined together through laser welding, they may be joined together by the use of other welding methods including resistance welding.

According to a first illustrative aspect of the invention, there is provided a manufacturing method for a ignition plug comprising an insulator having an axial hole and a center electrode provided in the axial hole, a substantially cylindrical metal shell and a plate-shaped ground electrode having a through hole formed in a center thereof, the manufacturing method including: a preparation step of preparing an insulator having a cavity provided at a leading end portion thereof by disposing a leading end of the center electrode more inwards in the axial hole than a leading end of the insulator; a build-in step of building the insulator in an interior of the metal shell; a disposing step of disposing the ground electrode at a leading end portion of the metal shell; an aligning step of co-axially aligning or co-axially positioning a center of the through hole of the ground electrode and a center of the cavity of the insulator; and a welding step of welding the ground electrode and the metal shell together after the positioning step.

According to the first illustrative aspect of the invention described above, the center of the through hole of the ground electrode and the center of the cavity of the insulator can be positioned before the ground electrode and the metal shell are welded together. Because of this, a shift in position between a center axis of the through hole and a center axis of the cavity can be eliminated.

According to a second illustrative aspect of the invention, there is provided a ignition plug manufacturing method as set forth in the first illustrative aspect, wherein in the positioning step, the center of the through hole and the center of the cavity are positioned by fitting a predetermined jig which fits in both the through hole and the cavity in the through hole of the ground electrode and the cavity of the insulator. According to the manufacturing method described above, by the use of the predetermined jig, the center of the through hole of the ground electrode and the center of the cavity of the insulator can be positioned accurately.

According to a third illustrative aspect of the invention, there is provided a ignition plug manufacturing method as set forth in the second illustrative aspect, wherein the jig has a post-shaped head portion which fits in the cavity and a post-shaped body portion which fits in the through hole, and center axes of the head portion and the body portion are formed on the same axis. By the use of the jig which has the post-shaped head portion which fits in, the cavity and the post-shaped body portion which fits in the through hole and in which the center axes of the head portion and the body portion are formed on the same axis in the way described above, the center of the through hole of the ground electrode and the center of the cavity of the insulator can easily be position on the same axis.

According to a fourth illustrative aspect of the invention, there is provided a ignition plug manufacturing method as set forth in the first illustrative aspect, including further a detecting step of sensing an image including the cavity of the insulator from a leading end side of the ignition plug and detecting a center of the cavity of the insulator based on the image so sensed, and wherein in the positioning step, the center of the through hole of the ground electrode and the center of the cavity of the insulator which was detected in the detecting step are positioned. According to the manufacturing method described above, the center of the through hole of the ground electrode and the center of the cavity of the insulator can be positioned without applying a physical load to the periphery of the cavity of the insulator.

According to a fifth illustrative aspect of the invention, there is provided a ignition plug manufacturing method as set forth in the first illustrative aspect, including further a detecting step of sensing an image including the through hole of the ground electrode and the cavity of the insulator from a leading end side of the ignition plug and detecting a center of the through hole of the ground electrode and a center of the cavity of the insulator based on the image so sensed, and wherein in the positioning step, the center of the through hole of the ground electrode and the center of the cavity of the insulator which were detected in the detecting step are positioned. By the manufacturing method described above, too, the center of the through hole of the ground electrode and the center of the cavity of the insulator can be positioned without applying a physical load to the periphery of the cavity of the insulator.

According to a sixth illustrative aspect of the invention, there is provided a ignition plug manufacturing method as set forth in any one of the first illustrative aspect to the fifth illustrative aspect, wherein in the welding step, the ground electrode and the metal shell are laser welded together. In the event that the ground electrode and the metal shell are made to be laser welded together in the way described above, the ground electrode and the metal shell can be joined together with good accuracy.

According to a seventh illustrative aspect of the invention, there is provided an ignition plug manufacturing method as set forth in the sixth illustrative aspect, wherein in the welding step, the laser welding is implemented after the ground electrode has been pressed against the metal shell side. In the event that the laser welding is implemented after the ground electrode has been pressed against the metal shell side as described above, the separation of the ground electrode from the metal shell due to an impact generated at the time of laser welding can be suppressed.

According to an eighth illustrative aspect of the invention, there is provided an ignition plug manufacturing method as set forth in the second illustrative aspect or the third illustrative aspect, wherein the jig includes a pressing portion for pressing the ground electrode against the metal shell side, and wherein in the welding step, the pressing is implemented by the use of the pressing portion of the jig, and then, the ground electrode and the metal shell are laser welded together. In the event that the pressing portion which presses the ground electrode against the metal shell side is provided integrally on the jig in the way described above, since positioning and pressing can be implemented at the same time, it becomes possible to manufacture the ignition plug easily.

In the welding step, the laser welding can be implemented as described in the following a ninth illustrative aspect to an eleventh illustrative aspect depending upon the disposition and shapes the ground electrode and the metal shell.

According to a ninth illustrative aspect of the invention, there is provided a ignition plug manufacturing method as set forth in any one of the sixth illustrative aspect to the eighth illustrative aspect, wherein a fitting stepped portion in which the ground electrode is loosely fitted is provided on an inner circumference of the leading end portion of the metal shell, wherein in the displaying step, the disposition of the ground electrode at the leading end portion of the metal shell is implemented by loosely fitting the ground electrode in the fitting stepped portion of the metal shell, and in the welding step, the laser welding is implemented by shining a laser beam towards a boundary between the fitting stepped portion of the metal shell and the ground electrode from a perpendicular direction or an oblique direction.

According to a tenth illustrative aspect of the invention, there is provided an ignition plug manufacturing method as set forth in any one of the sixth illustrative aspect to the ninth illustrative aspect, wherein the leading end portion of the metal shell is formed into a substantially flat plane and the diameter of the leading end portion of the metal shell and the diameter of the ground electrode are substantially the same, and wherein in the disposing step, the ground electrode is disposed on a leading end face of the metal shell, and in the welding step, the laser welding is implemented by shining a laser beam towards a boundary between the metal shell and the ground electrode from a perpendicular direction or an oblique direction.

According to an eleventh illustrative aspect of the invention, there is provided an ignition plug manufacturing method as set forth in any one of the sixth illustrative aspect to the tenth illustrative aspect, wherein the leading end portion of the metal shell is formed into a substantially flat plane and the diameter of the leading end portion of the metal shell is larger than the diameter of the ground electrode, and wherein in the disposing step, the ground electrode is disposed on a leading end face of the metal shell, and in the welding step, the laser welding is implemented by shining a laser beam towards a boundary between the metal shell and the ground electrode from an oblique direction.

According to a twelfth illustrative aspect of the invention, there is provided an ignition plug manufacturing method as set forth in any one of the first illustrative aspect to the eleventh illustrative aspect, wherein a noble metal member is joined to a circumference of the through hole of the ground electrode. In this way, in the event that the noble metal member is provided on the periphery of the through hole of the ground electrode, the durability of the ignition plug can be increased

What is claimed is:

1. A method of manufacturing an ignition plug having an insulator with an axial hole, a center electrode provided in the axial hole, a substantially cylindrical metal shell and a plate-shaped ground electrode having a through hole formed in a center thereof, the method comprising:

preparing an insulator having a cavity formed at a leading end portion thereof, said cavity formed by disposing a leading end of the center electrode in the axial hole of the insulator such that the leading end of the center electrode is recessed from a leading end of the insulator;

assembling the insulator in an interior of the metal shell wherein the position of the insulator is fixed relative to the metal shell by crimping the metal shell to the insulator;

disposing the ground electrode at a leading end portion of the metal shell;

axially aligning a center of the through hole of the ground electrode and a center of the cavity of the insulator using a jig having first and second portions, wherein the first portion of the jig is disposed within the cavity of the insulator and the second portion of the jig is disposed within the through hole of the ground electrode to axially align the center of the through hole of the ground electrode and the center of the cavity of the insulator; and welding the ground electrode and the metal shell together after the position of the insulator is fixed relative to the metal shell and after axially aligning the center of the through hole of the ground electrode and the center of the cavity of the insulator.

2. The method according to claim 1, wherein the first portion of the jig is a post-shaped head portion and the second portion of the jig is a post-shaped body portion, wherein center axes of the head portion and the body portion are formed on the same axis.

3. The method according to claim 1, wherein the jig comprises a pressing portion for pressing the ground electrode against the metal shell side, and wherein the ground electrode and the metal shell are laser welded together when the pressing is implemented by the use of the pressing portion of the jig.

4. The method according to claim 3, wherein a fitting stepped portion is provided on an inner circumference of the leading end portion of the metal shell, wherein the ground electrode is dimensioned to loosely fit in the fitting stepped portion of the metal shell, and the laser welding is implemented by shining a laser beam towards a boundary between the fitting stepped portion of the metal shell and the ground electrode from a perpendicular direction or an oblique direction.

5. The method according to claim 1, wherein the ground electrode and the metal shell are laser welded together.

6. The method according to claim 5, wherein the laser welding is implemented after the ground electrode has been pressed against the metal shell side.

7. The method according to claim 6, wherein a fitting stepped portion is provided on an inner circumference of the leading end portion of the metal shell, and wherein the ground electrode is dimensioned to loosely fit in the fitting stepped portion of the metal shell, and the laser welding is implemented by shining a laser beam towards a boundary between the fitting stepped portion of the metal shell and the ground electrode from a perpendicular direction or an oblique direction.

8. The method according to claim 6, wherein the leading end portion of the metal shell is formed into a substantially flat plane and the diameter of the leading end portion of the metal shell and the diameter of the ground electrode are substantially the same, and wherein the ground electrode is disposed on a leading end face of the metal shell, and the laser welding is implemented by shining a laser beam towards a boundary between the metal shell and the ground electrode from a perpendicular direction or an oblique direction.

9. The method according to claim 6, wherein the leading end portion of the metal shell is formed into a substantially flat plane and the diameter of the leading end portion of the metal shell is larger than the diameter of the ground electrode, and wherein the ground electrode is disposed on a leading end face of the metal shell, and the laser welding is implemented by shining a laser beam towards a boundary between the metal shell and the ground electrode from an oblique direction.

10. The method according to claim 5, wherein a fitting stepped portion is provided on an inner circumference of the leading end portion of the metal shell, and wherein the ground electrode is dimensioned to loosely fit in the fitting stepped portion of the metal shell, and the laser welding is implemented by shining a laser beam towards a boundary between the fitting stepped portion of the metal shell and the ground electrode from a perpendicular direction or an oblique direction.

11. The method according to claim 5, wherein the leading end portion of the metal shell is formed into a substantially flat plane and the diameter of the leading end portion of the metal shell and the diameter of the ground electrode are substantially the same, and wherein the ground electrode is disposed on a leading end face of the metal shell, and the laser welding is implemented by shining a laser beam towards a boundary between the metal shell and the ground electrode from a perpendicular direction or an oblique direction.

12. The method according to claim 5, wherein the leading end portion of the metal shell is formed into a substantially flat plane and the diameter of the leading end portion of the metal shell is larger than the diameter of the ground electrode, and wherein the ground electrode is disposed on a leading end face of the metal shell, and the laser welding is implemented by shining a laser beam towards a boundary between the metal shell and the ground electrode from an oblique direction.

13. The method according to claim 1, wherein the jig comprises a pressing portion for pressing the ground electrode against the metal shell side, and wherein the ground electrode and the metal shell are laser welded together when the pressing is implemented by the use of the pressing portion of the jig.

14. The method according to claim 13, wherein a fitting stepped portion is provided on an inner circumference of the leading end portion of the metal shell, and wherein the ground electrode is dimensioned to loosely fit in the fitting stepped portion of the metal shell, and the laser welding is implemented by shining a laser beam towards a boundary between the fitting stepped portion of the metal shell and the ground electrode from a perpendicular direction or an oblique direction.

15. The method according to claim 1, wherein a noble metal member is joined to a circumference of the through hole of the ground electrode.

* * * * *